United States Patent [19]

Okuno

[11] Patent Number: 4,810,840

[45] Date of Patent: Mar. 7, 1989

[54] DEAD TANK CIRCUIT BREAKER

[75] Inventor: Michiharu Okuno, Amagasaki, Japan

[73] Assignee: Mitsubishi Denki Kabushiki Kaisha, Tokyo, Japan

[21] Appl. No.: 206,130

[22] Filed: Jun. 13, 1988

[30] Foreign Application Priority Data

Jul. 2, 1987 [JP] Japan ..... 62-167162

[51] Int. Cl.[4] ..... H01H 33/16

[52] U.S. Cl. ..... 200/144 AP; 200/148 R; 200/148 B

[58] Field of Search ..... 200/144 AP, 148 R, 148 B, 200/148 G, 148 A, 145

[56] References Cited

U.S. PATENT DOCUMENTS 3,885,114 5/1975 Guaglione et al. ..... 200/148 R
4,075,447 2/1978 Rostron ..... 200/144 AP
4,103,128 7/1978 Kosaku ..... 200/145
4,207,446 6/1980 Sasaki et al. ..... 200/144 AP

FOREIGN PATENT DOCUMENTS 18618 6/1976 Japan .
38669 4/1978 Japan .

*Primary Examiner*—Robert S. Macon
*Attorney, Agent, or Firm*—Oblon, Fisher, Spivak, McClelland & Maier

[57] ABSTRACT

A dead tank circuit breaker comprises a grounded tank, bushings placed on the tank, an interrupting means housed in the tank and having both ends extended out through the respective bushings, and a capacitor arranged in the neighborhood of at least one of the bushings, wherein the capacitor has one terminal electrically and mechanically connected to the leading end of the bushing and the other termianl electrically and mechanically connected to the grounded tank.

3 Claims, 5 Drawing Sheets

DEAD TANK CIRCUIT BREAKER

BACKGROUND OF THE INVENTION

1. Field of the Invention

The present invention relates to the arrangement of a capacitor which is utilized in a tank type circuit breaker.

2. Discussion of Background

In general, such capacitor is arranged between the contacts to perform voltage-dividing so as to relatively equalize the voltages at each breaks in a multi-interrupting point type circuit breaker or improves the breaker performance under severe interrupting conditions wherein a high rate of rise of restriking voltage is caused in case of a short line fault and so on. The voltage-dividing capacitor in the multi-break circuit breaker can also contribute to the improvement of the breaker performance. In addition, in case of the single break circuit breaker, a capacitor between contacts is usually used when a great interrupting capacity in a short line fault is required.

The capacitor is generally arranged within a grounded tank to surround an arc-extinguishing chamber therein. Several proposals have been made on the assumption that the capacitor is arranged in the grounded tank (see Japanese Examined Patent Publication No. 18618/1976, Japanese Unexamined Utility Model Publication No. 38669/1978). FIGS. 3 and 4 are a front view and a vertical sectional view showing the structure of a conventional tank type circuit breaker as disclosed in e.g. the Japanese Unexamined Utility Model Publication No. 38669/1978. In FIGS. 3 and 4, a grounded tank 2 is shown supported on a platform 1. The grounded tank 2 has a pair of bushings 3, 3 mounted on the top so as to project upward. Conductors 4, 4 extend through both bushings 3, 3. Bushing current transformers 5, 5 are arranged between the grounded tank 2 and each bushing 3 so as to be insulated from and be wound around each conductor 4, thereby detecting a current through each conductor. The grounded tank 2 includes an insulation member 6 which is attached on one of the end walls of the tank. A piston 7 is attached to the insulation member 6, has a through hole and is connected to one of the conductors 4. Into the piston 7, is fitted a puffer cylinder 8 so as to be slidable with respect to the piston. A movable contact 9 is inserted into the through hole of the piston 7 so as to be slidable therein, and is fixed to the puffer cylinder 8. A nozzle 10 is fixed to the puffer cylinder 8 so as to surround the movable contact 9 with a predetermined gap. The piston 7 also has an insulation member fixed thereto. A stationary contact 12 is fixed to the insulation member 11 so that it is opposite to the movable contact 9 so as to be engageable therewith and disengageable therefrom. The stationary contact is connected to the other conductor 4. A capacitor 13 is arranged between the piston 7 and the stationary contact 12 in the neighborhood of both contacts. The capacitor has a structure wherein a plurality of ceramic elements having a high dielectric constant are arranged in series and parallel combinations. The piston 7, the puffer cylinder 8, the movable contact 9, the nozzle 10, the insulation member 11, the stationary contact 12 and the capacitor 13 form an arc-extinguishing chamber 14 as an interrupting unit. The grounded tank 2 is filled with $SF_6$ gas 17 as an insulation medium. Operating means 15 as shown in FIG. 3, is provided to reciprocate the movable contact 9 so as to engage with and disengage from the stationary contact 12. Each conductor 4 has a main circuit terminal 16 attached to the leading edge 4*a*.

The interrupting operation is as follows: Current flows from the conductor 4 in one of the bushings 3 to the conductor 4 in the other bushing 3 through the contacts 9, 12 being connected in the arc-extinguishing chamber 14. The bushing current transformers 5, 5 detect the currents flowing through the conductors 4. When one of the current transformers detects a ground fault current, the operating means 15 activates to move the puffer cylinder 8, the movable contact 9 and the nozzle 10 in the right direction indicated by an arrow A in FIG. 4 so as to disengage the movable contact 9 from the stationary contact 12. At that time, a high voltage of arc is created between the contacts 9 and 12. Since the arc has a great deal of energy, it gives radiant heat around itself, and it raises the pressure and temperature of the $SF_6$ gas 17 to high levels. The $SF_6$ gas 17 in the puffer cylinder 8 is compressed between the fixed piston 7 and the moved puffer cylinder 8, so that the compressed $SF_6$ gas 17 is blasted to the arc through the nozzle 10 so as to cool it, thereby interrupting the current.

In case of an a.c. circuit breaker, when the current comes to 0, it is interrupted, and then a recovering voltage is applied between the contacts of the interrupting means. The circuit breaker is very sensitive to the recovering voltage. The initial rate of rise of the recovering voltage has a significant effect on the breaker performance. The waveform of the recovering voltage at that time is determined by inductance, capacitance and several kinds of loss components, which distribute in the line. When a ground fault happens to the line, the capacitor 13 inserted between the line and ground can be delay the rise of the recovering voltage on the line and reduce severity in the interrupting conditions. For the reasons, in circuit breakers for a high-amperage current which is required for severe interrupting performance at the time of a short line fault, it is well known that there is provided such capacitor.

Since the conventional tank type circuit breaker is constructed as above, the capacitor 13 is exposed to the insulation medium 17 having a high temperature or the arc radient heat, which accelerates the deterioration of the capacitor 13. In addition, since there is some space required between both contacts 9 and 12 and the capacitor 13, and insulation distance is needed between the capacitor 13 and the grounded tank 2, a large diameter of grounded tank 2 is required, which is disadvantageous.

SUMMARY OF THE INVENTION

It is an object of the present invention to eliminate the disadvantages of the conventional dead tank circuit breaker and to provide a new and improved dead tank circuit breaker capable of minimizing the deterioration of the capacitor and the diameter of the grounded tank.

It is another object to provide a dead tank circuit breaker capable of detecting a line voltage as well.

According to the present invention, the dead tank circuit breaker is especially noteworthy in that a capacitor is arranged in the neighborhood of at least one of bushings, and that one terminal of the capacitor is electrically and mechanically connected to the leading end of the bushing and the other terminal is electrically and mechanically connected to a grounded tank.

In another aspect of the present invention, the dead tank circuit breaker is especially noteworthy in that a first capacitor is arranged in the neighborhood of at least one of the bushings, and that one terminal of the first capacitor is electrically and mechanically connected to the leading end of the bushing, the other terminal is connected to one terminal of a second capacitor and the other terminal of the second capacitor is grounded so as to detect voltage across the second capacitor.

In accordance with the present invention, the capacitor is arranged in the neighborhood of the bushing. As a result, when a ground fault occurs, the capacitor can be prevented from being affected by arc while the capacitor plays the same role as the interpolar capacitor in the conventional circuit breaker. In addition, it is possible to shorten the distance between the grounded tank and both contacts. Furthermore, it is easy to combine the capacitor with the circuit breaker as one unit.

In case of the provision of the first and second capacitors, there is also an advantage that a line voltage can be divided by the capacitors.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
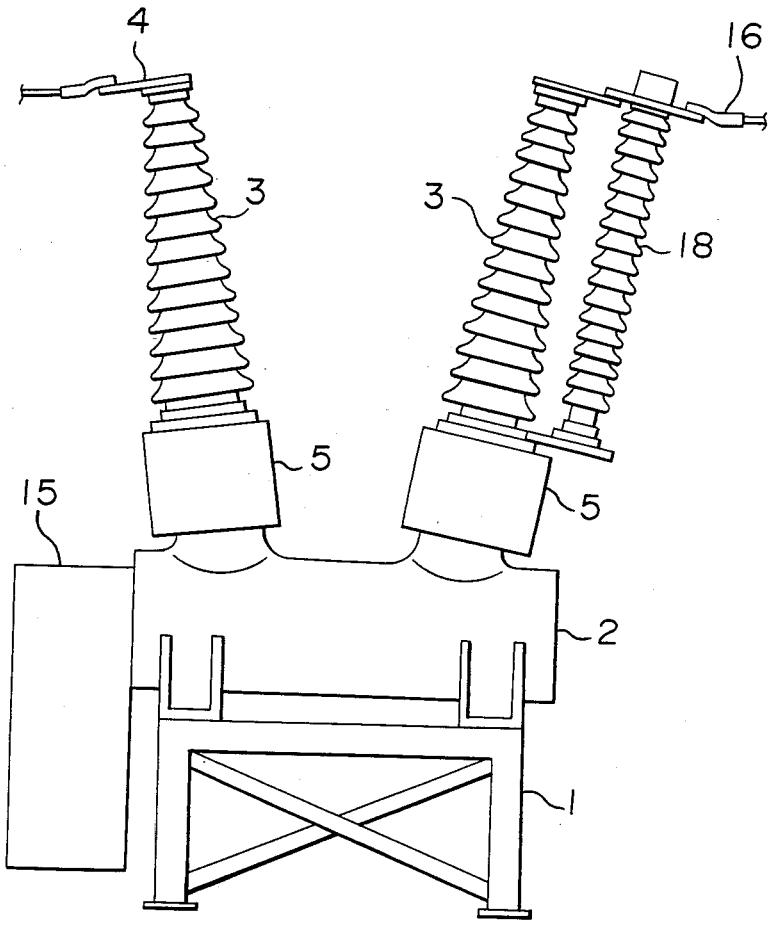
FIG. 1 is a front view showing an embodiment of the dead tank circuit breaker according to the present invention.
Figure 3:
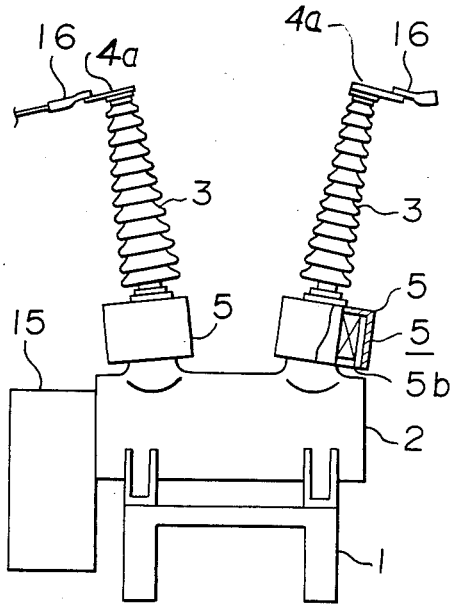
FIG. 3 is a front view showing the structure a conventional dead tank circuit breaker.
Figure 4:
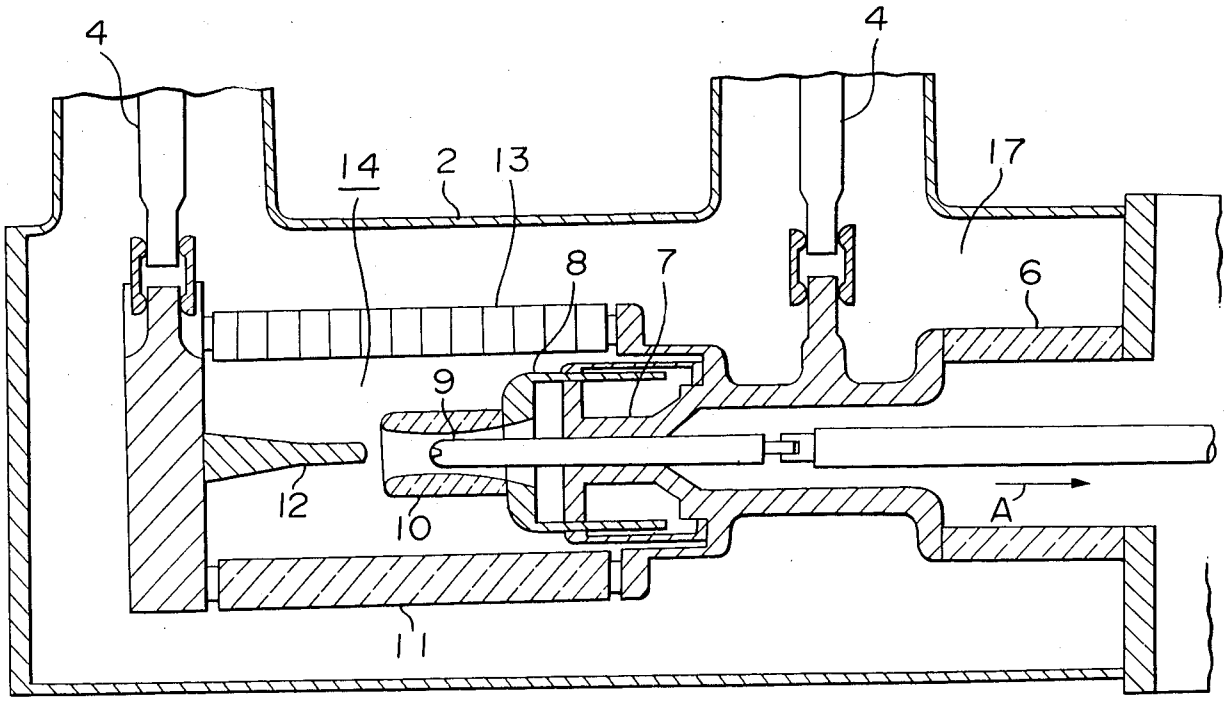
FIG. 4 is a vertical cross sectional view showing the structure of an arc-extinguishing chamber of the conventional circuit breaker.

Now, an embodiment of the present invention will be explained referring to FIG. 1. In FIG. 1, elements indicated by reference numerals 1 through 11, and 14 through 17 are the same as those in the conventional circuit breaker as shown in FIGS. 3 and 4. These elements are combined in the same way as the conventional circuit breaker. The major distinction between the present invention and the conventional one will be described in detail. An oil-immersed capacitor 18 is arranged in the neighborhood of the bushing 3 on the line side, instead of the capacitor between contact. One terminal of the capacitor is electrically and mechanically connected to the leading end of the bushing 3. The other terminal of the capacitor is electrically and mechanically connected to a mounting portion for bushing on the grounded tank 2 to be grounded. The oil-immersed capacitor can work effectively to interrupt current at the time of a short line fault. The capacitor 18 may be constituted by an $SF_6$ gas capacitor or a highly dielectric capacitor comprising a ceramic element as usual. The capacitor 18 is housed in porcelain tubes.

The interrupting operation is as follows:

Current flows from one of the former main circuit terminals 16 to the other main circuit terminal 16 through the conductor 4 in the bushing 3 with the main circuit terminal, the contacts 9 and 12 in the arc-extinguishing chamber 14 and the conductor 4 in the other bushing 3. The currents flowing through the conductors 4 are detected by the bushing current transformers 5. When a grounding fault occurs on the line, the line, the ground and the capacitor 18 forms a circuit like the conventional circuit breaker. As a result, the capacitor 18 delays the rise of the recovering voltage on the line and activates the circuit breaker effectively when a high-amperage current must be interrupted in the time of a short line fault.

In the dead tank circuit breaker as constructed above, it is possible to reduce the size of the grounded tank 2 in comparison with the conventional circuit breaker. That allows the grounded tank 2 of the dead tank circuit breaker for interrupting a high-amperage current to be formed in the same size as that of the dead tank circuit breaker for interrupting a low-amperage current without a capacitor. As a result, it is possible to standardize the grounded tank.

If a short circuit fault happens to such capacitor 18, the short circuit current flowing through the capacitor 18 can be detected by the bushing current transformer 5 to find the occurance of the short circuit fault of the capacitor 18 based on the detected value.

Figure 2:
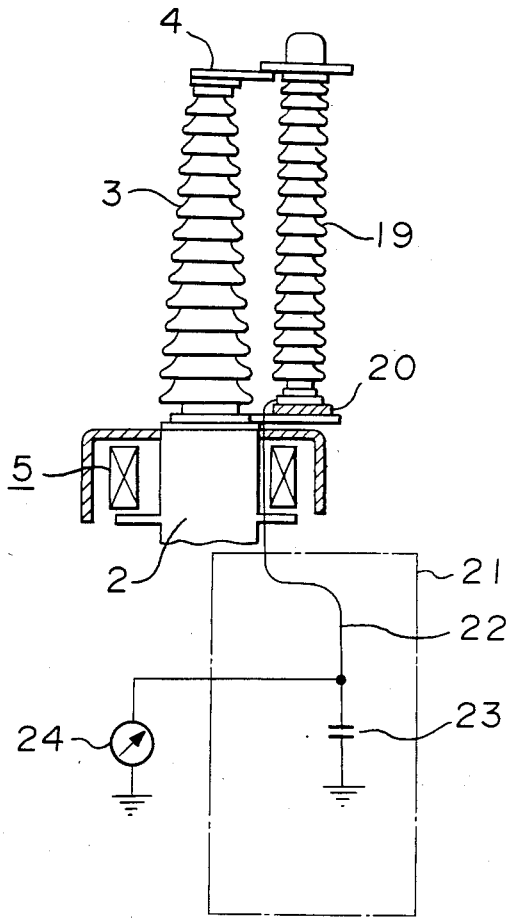
FIG. 2 is a fragmentary view, partly in vertical section of another embodiment of the dead tank circuit breaker according to the present invention.

FIG. 2 is a fragmentary view, partly in vertical section, showing another embodiment. The second embodiment is different from the first embodiment in that a capacitor is placed across the conductor 4 in the bushing 3 which is located on the side opposite to the line side in order to use the capacitor as a potential transformer (PT). The capacitor 19 is arranged in the neighborhood of the bushing 3, it has one terminal electrically and mechanically connected to the leading and of the bushing 3, and it works as a first capacitor. An insulation plate 20 is placed between the first capacitor 19 and the grounded tank 2 to insulate the first capacitor 19 from the grounded tank 2. A control box 21 for the circuit breaker is positioned below the grounded tank 2, and is electrically connected to the grounded tank 2. A wire 22 is provided o as to have one end connected to the other terminal of the first capacitor 19, and the wire passes through the bushing current transformer 5. A second capacitor 23 having a relatively larger capacity in comparison with the first capacitor 19 is arranged in the control box 21. The second capacitor has one terminal connected to the wire 22 and the other terminal connected to the grounded tank 2 through the control box 21. There is provided a measuring instrument 24 for measuring voltage at the junction of the first capacitor 19 and the second capacitor 23. The voltage at the junction can be voltage-divided to a level required for measurement by fully increasing the capacitance of the second capacitor 23 over the capacitance of the first capacitor 19. The voltage at the junction is detected, and the detected value is calculated backward based on the voltage dividing ratio to find the line voltage.

The dead tank circuit breaker as constructed above can activate effectively to interrupt a high-amperage current accompanied by a high rate of rise of the restriking voltage at the time of a short line fault like the first embodiment.

In addition, since the wire 22 passes through the bushing current transformer 5, when a short circuit fault happens to the first capacitor 19, the fault current flows through the wire surrounded by the bushing current transformer 5. As a result, the bushing current transformer 5 can detect the fault current to find the occurrence of the fault.

Although the wire 22 is arranged to pass through the bushing current transformer 5 in the second embodiment, the wire may pass outside the bushing current transformer to connect the first capacitor 19 and the second capacitor 23.

In addition, although the second capacitor 23 is arranged in the control box 21 in the second embodiment, the first capacitor 19 and the second capacitor 23 may be mechanically put on one over the other. The thus coupled capacitors (not shown) is electrically connected between the conductor 4 at the leading end of the bushing 3 and the mounting portion for the bushing 3 of the grounded tank 2. The coupled capacitors have a terminal drawn out from the intermediate point for connecting to the measuring instrument.

Although, in the embodiments, the capacitor 18 is connected to only one of the bushings 3, the capacitors 18 have one terminal connected to the conductor 4 at the leading end of the respective bushings 3 and the other terminal connected to the grounded tank 2.

The embodiments have been described when the circuit breaker is used in a single-phase transmission line. When the circuit breaker is used in a three-phase transmission line, three sets of the single-phase circuit breaker of the embodiments are used. If a common enclosure circuit breaker with three-phase arc extinguishing chambers housed in an single grounded tank is utilized, a pair of bushings 3 are provided for each phase, and the capacitors 18 are arranged in each phase so that the pair of bushings for each phase are treated in the same way as the embodiments. Thus, the present invention is also applicable to a three-phase circuit breaker.

By the way, although the embodiments have been explained with respect to the tank type circuit breaker, the circuit breaker can be of course installed in a gas insulation substation.

As explained, in accordance with the present invention, the capacitor is arranged in the neighborhood of at least one of the bushings, and the capacitor has one terminal electrically and mechanically connected to the leading end of the bushing and the other terminal electrically and mechanically connected to the grounded tank. As a result, the capacitor is prevented from being exposed to the arc, which can extend the life of the capacitor. In addition, there is an advantage that the grounded tank can be minimized because the capacitor can be removed from the inside of the grounded tank.

Furthermore, when the capacitor arranged in the neighborhood of the bushing is used as the first capacitor, the other terminal of the first capacitor is insulated from the grounded tank, the other terminal is connected to the one terminal of the second capacitor and the other terminal of the second capacitor is grounded, there is an advantage that the voltage across the second capacitor can be detected to find the line voltage, in addition to the advantage as just stated.

Obviously, numerous modifications and variations of the present invention are possible in light of the above teachings. It is therefore to be understood that within the scope of the appended claims, the invention may be practiced otherwise than as specifically described herein.

What is claimed is:

1. A dead tank circuit breaker comprising:

a grounded tank, bushings placed on the tank, interrupting means housed in the tank and having both ends extended out through the respective bushings, and a capacitor arranged in the neighborhood of at least one of the bushings, wherein the capacitor has one terminal electrically and mechanically connected to the leading end of the bushing and the other terminal electrically and mechanically connected to the grounded tank.

2. A dead tank circuit breaker comprising:

a grounded tank, bushings placed on the tank, interrupting means housed in the tank and having both ends extended out through the respective bushings, a first capacitor arranged in the neighborhood of at least one of the bushings, and a second capacitor, wherein the first capacitor has one terminal electrically and mechanically connected to the leading end of the bushing, the first capacitor has the other terminal connected to one terminal of the second capacitor, and the second capacitor has the other terminal grounded so as to be capable of detecting voltage across the second capacitor.

3. A dead tank circuit breaker according to claim 2, wherein the second capacitor has the other terminal electrically connected to the grounded tank.

* * * * *